US006997996B1

(12) United States Patent
Manning et al.

(10) Patent No.: US 6,997,996 B1
(45) Date of Patent: Feb. 14, 2006

(54) HIGH ENERGY THERMOPLASTIC ELASTOMER PROPELLANT

(75) Inventors: Thelma G. Manning, Montville, NJ (US); Joseph L. Prezelski, Jermyn, PA (US); Sam Moy, Parsippany, NJ (US); Bernard Strauss, Rockaway, NJ (US); James A. Hartwell, Elton, MD (US); Arpad Juhasz, Joppatowne, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 333 days.

(21) Appl. No.: 09/665,190

(22) Filed: Sep. 12, 2000

Related U.S. Application Data

(63) Continuation-in-part of application No. 09/351,530, filed on Jul. 12, 1999, now abandoned, which is a continuation-in-part of application No. 09/038,490, filed on Mar. 6, 1998, now abandoned, which is a continuation-in-part of application No. 08/744,042, filed on Nov. 6, 1996, now abandoned.

(60) Provisional application No. 60/006,671, filed on Nov. 13, 1995.

(51) Int. Cl.
*C06B 45/10* (2006.01)
*C06B 25/34* (2006.01)
*D03D 23/00* (2006.01)

(52) U.S. Cl. ..... 149/19.6; 149/92; 149/109.6; 264/3.1

(58) Field of Classification Search ..... 149/19.6, 149/19.92, 92, 109.6; 264/3.1, 3.3
See application file for complete search history.

(56) References Cited

U.S. PATENT DOCUMENTS 3,960,993 A * 6/1976 Johnson et al. ..... 264/3.3
4,092,188 A 5/1978 Cohen et al.
4,650,617 A * 3/1987 Kristofferson et al. ..... 264/3.3
4,707,540 A 11/1987 Manser et al.
4,726,919 A 2/1988 Kristofferson et al.
4,804,424 A 2/1989 Hinshaw
4,919,737 A 4/1990 Biddle et al.
4,976,794 A 12/1990 Biddle et al.
5,129,304 A * 7/1992 Loomans et al. ..... 264/3.3
5,210,153 A 5/1993 Manser et al.
5,368,662 A 11/1994 Willer et al.
5,516,854 A 5/1996 Wardle et al.
5,529,649 A 6/1996 Lund et al.
5,540,794 A 7/1996 Willer et al.
5,565,150 A 10/1996 Dillehay et al.
5,690,868 A * 11/1997 Strauss et al. ..... 264/3.1
5,716,557 A * 2/1998 Strauss et al. ..... 264/3.3
5,717,158 A * 2/1998 Capellos et al. ..... 149/19.4
5,759,458 A * 6/1998 Haaland et al. ..... 264/3.3
5,798,481 A * 8/1998 Manning et al. ..... 149/19.6
6,171,530 B1 * 1/2001 Haaland et al. ..... 264/3.3

OTHER PUBLICATIONS

Dr. Robert B Wapole, Louis Canuizzo, R. Scott Hamilton, Dr. Jerald E. Hinshaw Evergetic Oxctave Theroplastic Elastomer Binders Office of Naval Research, Dept. of Navy, Arlington, VA Contract EN00014-90-E-0264 Final Report, Mar. 1994, 75 pps.
Abstract; pp. 13-15, D-1, E-1, E-6, E-7, E-8, F-1, F-4, F-5.

* cited by examiner

*Primary Examiner*—Aileen Felton
(74) *Attorney, Agent, or Firm*—Robert Charles Beam; John F. Moran

(57) ABSTRACT

A high energy propellant, comprising an oxetane thermoplastic elastomer energetic binder admixed with a high energy explosive filler. The oxetane thermoplastic elastomer energetic binder preferably comprises from about five percent to about thirty percent by weight and the high energy explosive filler comprises from about seventy percent to about ninety-five percent by weight of the composition. A preferred propellant further includes an explosive plasticizer, preferably in an amount of about four percent to about seven percent of the plasticizer by weight of the propellant. The preferred filler is selected from the group consisting of CL-20, TNAZ, RDX and mixtures thereof. The preferred plasticizer is selected from the group consisting of TNAZ, BTTN, TMETN, TEGDN, BDNPA/F, methyl NENA, ethyl NENA and mixtures thereof. In a preferred embodiment, the propellant is actually a pair of high energy propellants comprising a mixture of first and second high energy propellants with the first propellant having a burning rate at least two times faster than the burning rate of the second propellant. The first propellant includes an oxetane thermoplastic elastomer energetic binder admixed with CL-20 high energy explosive filler. The second propellant including an oxetane thermoplastic elastomer energetic binder admixed with RDX high energy explosive filter. Plasticizers and relative amounts for each of the first and second propellants are the same as for the single propellant.

10 Claims, No Drawings

HIGH ENERGY THERMOPLASTIC ELASTOMER PROPELLANT

This application, Ser. No. 09/665,190, was filed on Sep. 12, 2000, as a continuation-in-part of U.S. patent application Ser. No. 09/351,530, filed on Jul. 12, 1999, now abandoned which was a continuation-in-part of U.S. patent application Ser. No. 09/038,490, filed on Mar. 6, 1998, now abandoned which was a continuation-in-part of U.S. patent application Ser. No. 08/744,042, filed on Nov. 6, 1996, now abandoned claiming priority of Provisional Application No. 60/006,671, filed on Nov. 13, 1995.

FIELD OF THE INVENTION

The present invention relates generally to a high energy propellant composition. More particularly the invention relates to a propellant that includes an energetic thermoplastic elastomer as a binder and a high energy, high density filler.

BACKGROUND OF THE INVENTION

As with the evolution of many technologies, new weapon systems require higher munitions performance. Current standard propellants do not have adequate energy to deliver the performance required for systems that are presently being developed. JA2, which is a standard double base propellant used, for example, in the M829A1 and M829A2 tanks rounds, has an impetus value of 1150 Joules/gram or J/g. M43, which is used in the M900A1 cartridge, has an impetus of 1181 J/g. Both of these conventional propellants do not have the energy level to deliver the muzzle velocity required in future high energy tank systems such as the M829E3. Theoretical calculations have shown that a propellant containing an energy above the 1300 J/g threshold is needed.

In addition to the energy content, it has been shown by theoretical calculations that the ballistic cycle can be optimized and work output can be maximized by using a combination of two equienergetic propellants whose burning rates are different by a factor of three or four. The slow burning propellant is designed to enter the cycle at a later time. Current standard propellants do not exhibit such wide variation in burning rates at a specified energy level. Standard tank gun propellants such as XM39, M43, M44 or JA2 have burning rate differentials that are, at best, less than two to one, and thus they are unsatisfactory for solving the problem of delivering much higher muzzle velocities.

In addition to the inability to generate adequate energy levels, present day propellants produce volatile organic compounds and ancillary waste, especially in enhanced demil and recyclability.

Accordingly, one object of the present invention is to provide a pair of high energy propellants whose average impetus is at or above the 1300 J/g level.

Another object of this invention is to provide a pair of high energy propellants whose burning rate differential is three or greater.

An additional object of this invention is to provide new energetic materials and processes that eliminate or greatly reduce both volatile organic compound production and ancillary waste through demil and recyclability.

Other objects will appear hereinafter.

SUMMARY OF THE INVENTION

It has now been discovered that the above and other objects of the present invention may be accomplished in the following manner. Specifically, it has now been discovered that an improved high energy propellant may be prepared that has an impetus value of at least 1300 J/g. This family of propellants is expected to be of great value in new versions of the M829 cartridge as well as for other future tank systems yet to be developed.

The propellant comprises an oxetane thermoplastic elastomer energetic binder admixed with a high energy explosive filler. An oxetane thermoplastic elastomer—can be melted at moderate elevated temperature and then solidified into an elastomeric material once it is cooled to a lower temperature such as ambient or lower. It is made from two types of monomers: 3,3-bis-azidomethyloxetane, or BAMO as a hard block, and 3-azidomethyl-3-methyloxetane, or AMMO as a soft block. The oxetane thermoplastic elastomer energetic binder, or AMMO/BAMO, eliminates the need for solvents in processing. It is included as a binder in an amount suitable for processing and formulating the desired propellant. Preferred amounts range from about five percent to about thirty percent by weight, based on the total weight of the propellant.

The high energy explosive filler comprises from about seventy percent to about ninety-five percent by weight of the propellant. There are a number or preferred propellant fillers, is selected from the group consisting of Hexanitrohexaazaioswurtzitane or CL-20, 1,3,3-Trinitrozaetidine or TNAZ, and the presently used RDX. Mixtures thereof are also contemplated, particularly in paired propellants as described below.

The preferred propellant of this invention may also include an explosive plasticizer, preferably in an amount of about four percent to about seven percent of the plasticizer by weight of the propellant. Examples of preferred plasticizers are 1,3,3-Trinitroazetidine or TNAZ, Butane-triotrinitrate or BTTN, Trimethylolethane, Trinitrate or TMETN, Triethylene Glycol Dinitrate or TEGDN, Bis, 2,2-Dinitro propyl acetal/Bis 2,2-Diniro propyl formal or BDNPA/F, Methyl Nitrato ethyl nitramine or methyl NENA, ethyl NENA. These plasticizers may be used alone or in combination.

It has also been discovered that a pair of high energy propellants may be combined to produce a propellant mixture having a first propellant having a burning rate at least three times faster than the burning rate of the second propellant. In the preferred embodiment, the first propellant includes an oxetane thermoplastic elastomer energetic binder admixed with CL-20 high energy explosive filler. The second propellant including an oxetane thermoplastic elastomer energetic binder admixed with RDX high energy explosive filler or RDX and TNAZ mixtures. The ratio of burning rates may be varied from at least 2.0 times to as high as 4.8 times, or higher. Of course, plasticizers and relative amounts for each of the first and second propellants are within the same ranges as for the single propellants.

DETAILED DESCRIPTION OF THE PREFERRED EMBODIMENT

The present invention has many advantages over the prior art propellant formulations. In its simplest form, the invention comprises an oxetane thermoplastic elastomer energetic binder admixed with a high energy explosive filler. A plasticizer may be added in some applications.

The oxetane thermoplastic elastomer energetic binder is an essential part of the invention, and is available from Thiokol Corporation. It is capable of being melted at elevated temperatures to allow the binder to be processable with other propellant ingredients without the use of solvents, and this is a major advantage. In addition, as will be shown below, the oxetane thermoplastic elastomer energetic binder has excellent mechanical properties that are superior to conventional propellants because of elastomeric characteristics, especially at cold temperatures such as −20° C. to −40° C. This binder also has good mechanical properties that are important for uniform ballistic performance as well as having low vulnerability to shaped charge jet impact.

In order to verify the excellent properties of the oxetane thermoplastic elastomer energetic binder, thermal stability tests were performed. Results of these tests are shown in Table I below.

TABLE I

| Sample | Self Heat, ° C. | Ignition, ° C. |
|---|---|---|
| OXETANE Only | 166 | 229 |
| OXETANE/TNAZ (1:1) | 153 | 216 |
| OXETANE/CL-20 (1:1) | 181 | 206 |
| OXETANE/RDX (1:1) | 196 | 222 |

In order to demonstrate the effectiveness of the propellants of this invention, a number of gun propellant formulations were mixed and extruded. The method of preparing the formulations comprised the steps of mixing at about 95° C. and extruding at slightly lower temperatures. Processing at these temperatures provided a safe operating margin of at least 50° C. because the self heat temperatures of the filler ranges from about 175° C. to 192° C., but the preferred plasticizer TNAZ melts around 100° C., so that as some of the TNAZ begins to melt during processing at 95° C., a more fluid mix results that is easier to process. Presented below in Table II are seven formulations that have been prepared. All values for the composition are given in percent by weight, based on the total weight.

TABLE II

| Sample | Oxetane | Filler/amount | Impetus, J/g | Flame, ° K. |
|---|---|---|---|---|
| A | 24 | CL-20/76 | 1297 | 3412 |
| B | 24 | TNAZ/76 | 1309 | 3321 |
| C | 20 | TNAZ/76* | 1335 | 3475 |
| D | 20 | CL-20/76* | 1324 | 3575 |
| E | 13.3 | RDX/80** | 1319 | 3395 |
| F | 18 | RDX/76*** | 1306 | 1348 |
| G | 20 | CL-20**** | 1348 | 3683 |

*Sample also included 4% BDNPA/F as plasticizer
**Sample also included 6.7% BDNPA/F as plasticizer
***Sample also included 6% TNAZ as plasticizer
****Sample also included 4% TNAZ is plasticizer.

Each of the above batches was formulated into a propellant by mixing and then extruding at a lower temperature. Selection and control of the precise extrusion parameters was important to obtain proper grain dimensions without excessive swelling or deformation. Table III below identifies the barrel temperature, die temperature and ram speed for each sample batch.

TABLE III

| Sample | Barrel temp., ° C. | Die temp. ° C. | Ram speed, in/min. |
|---|---|---|---|
| A | 82 | 70 | 0.14 |
| B | 95 | 86 | 0.14 |
| C | 89 | 82 | 0.06 |
| D | 87 | 78 | 0.03 |
| E | 100 | 91 | 0.14 |
| F | 100 | 85 | 0.08 |
| G | 66 | 55 | 0.04 |

Each of these formulations were tested for various properties to demonstrate the efficacy of the present invention. Specifically, impact, differential thermal analysis (DTA), and electrostatic and friction sensitivity characteristics. Presented below in Table IV are the results of these tests. The results show that impact sensitivities are similar to the conventional propellant M43, and that the products of this invention are quite thermally stable. A negative annotation for electrostatic sensitivity indicates no reaction to a 12 Joule electrostatic charge while a negative friction value is for a test with a 60 pound weight. The last two samples were not fully tested and n/a indicates that no data is available.

TABLE V

| Sample | Impact (cm) | DTE, Self heat (° C.) | DTA, Ignition (° C.) | Electrostatic (12 Joules) | Friction (Bole) |
|---|---|---|---|---|---|
| A | 50 | 179 | 203 | neg | neg |
| B | 40 | 175 | 211 | neg | neg |
| C | 20 | 175 | 212 | neg | neg |
| D | 40 | 174 | 206 | neg | neg |
| E | 40 | 206 | 225 | neg | neg |
| F | n/a | n/a | n/a | neg | neg |
| G | n/a | n/a | n/a | neg | neg |

The next evaluation of these samples were to determine the burn rate at various conditions. The data for the burn rates, presented below in Table VI, represent closed bomb data. As can be seen, RDX containing samples E and F have the slowest burning rates, which is comparable to the LOVA type M43 formulations. The CL-20 samples A, D and G have much faster burn rates, the improvement being about 2.7 times at 10,000 psi and 4.8 at 25,000 psi. The TNAZ filled samples B and C have intermediate burning rates and samples G is the fastest. Based upon this data, a combination of a first propellant having burning ratios at least three times faster than a second combined propellant is now possible.

TABLE VI

| Sample | 10 kpsi (inch/sec) | 15 kpsi (inch/sec) | 25 kpsi (inch/sec) | Exponent | Friction ($10^{-3}$) |
|---|---|---|---|---|---|
| A | 4.5 | 6.9 | 11.8 | 1.04 | 0.30 |
| B | 3.1 | 4.7 | 7.9 | 1.02 | 0.25 |
| C | 3.5 | 5.1 | 8.4 | 0.97 | 0.46 |
| D | 4.5 | 6.8 | 11.2 | 0.98 | 0.54 |
| E | 1.7 | 2.6 | 4.4 | 1.03 | 0.14 |
| F | 1.7 | 2.7 | 4.5 | 1.04 | 0.12 |
| G | 4.6 | 9.0 | 21.0 | 1.65 | 0.001 |

To complete the evaluation of the samples, some mechanical behavior tests were performed, the results of which are below in Table VII. Tests were done on an Instron test machine at low strain.

TABLE VII

| Sample | Stress, (psi) | % elong (@ max stress) | Modulus, (psi) | Fail Modulus, (psi) | Failure Mode |
|---|---|---|---|---|---|
| A | 1780 | 36.7 | 7650 | 742 | B |
| B | 1260 | 26.2 | 8370 | 2480 | B |
| C | 412 | 22.8 | 3160 | 1280 | B,P |
| D | 641 | 30.4 | 3190 | 456 | B,P |
| E | 555 | 16.5 | 6220 | 2870 | P,SC |
| F | 1970 | 18.8 | 18,800 | 5760 | P,S |
| G | 1680 | 30.8 | 8860 | 2860 | P |

The symbols for the failure data in the last column of Table VII are as follows: B=barrel, P=pancake, SC=slight crumble, and S=split.

The data shows that high energy gun propellants at an energy level of 1300 J/g can be formulated with an Oxetane binder in combination with high energy fillers. Desirable burning rates with burn rate differential by a factor of 3 or more can be obtained from these formulations.

While particular embodiments of the present invention have been illustrated and described herein, it is not intended that these illustrations and descriptions limit the invention. Changes and modifications may be made herein without departing from the scope and spirit of the following claims.

The invention claimed is:

1. An extruded propellant material comprising:

a first propellant composition comprising:

an energetic oxetane thermoplastic elastomeric binder comprising from about five percent to about thirty percent by weight, based on the total weight of said first propellant, and chosen from the group consisting of 3,3-bis-azidomethyl-oxetane (BAMO), 3-azidomethyl-3-methyloxetane (AMMO), and combinations thereof, and a high energy explosive filler comprising from about seventy percent to about ninety-five percent by weight, based on the weight of said first propellant, and chosen from the group consisting of hexanitrohexaazaisowurtzitane (CL-20), 1,3,3-trinitroazetidine (TNAZ), cyclotrimethylene trinitramine (RDX), and combinations thereof, said first propellant composition having an impetus of at least about thirteen hundred joules per gram (1300 J/g) and a first and relatively slow burn rate measured at 25 kpsi;

a second propellant composition comprising an energetic oxetane thermoplastic elastomeric binder comprising from about five percent to about thirty percent by weight, based on the total weight of said second propellant, and chosen from the group consisting of 3,3-bis-azidomethyl-oxetane (BAMO), 3-azidomethyl-3-methyloxetane (AMMO), and combinations thereof, and a high energy explosive filler comprising from about seventy percent to about ninety-five percent by weight, based on the weight of said second propellant, and chosen from the group consisting of hexanitrohexaazaisowurtzitane (CL-20), 1,3,3-trinitroazetidine (TNAZ), cyclotrimethylene trinitramine (RDX), and combinations thereof, said second propellant composition having an impetus of at least about thirteen hundred joules per gram (1300 J/g) and a second and relatively fast burn rate on the order of at least about three times faster than said first burn rate of said first propellant composition, as measured at 25 kpsi.

2. The propellant composition of claim 1, further comprising an explosive plasticizer comprising from about four percent to about seven percent by weight, based on the weight of said propellant composition, and chosen from the group consisting of 1,3,3-trinitroazetidine (TNAZ), butanetrio-trinitrate (BTTN), trimethylolethane trinitrate (TMETN), triethylene glycol dinitrate (TEGDN), bis,2,2-dinitropropylacetyl/bis2,2-dinitropropylformal (BDNPA/F), methylnitratoethylnitramine (methyl NENA), ethylnitratoethylnitramine (ethyl NENA), and combinations thereof.

3. The propellant composition of claim 1, wherein said second burn rate of said second propellant composition is at least about twenty-one inches per second (21.0 in./sec.) as measured at 25 kpsi.

4. The propellant composition of claim 1, wherein said first burn rate of said first propellant composition is below about five inches per second (5.0 in./sec.) as measured at 25 kpsi.

5. The propellant composition of claim 4, wherein said first burn rate of said first propellant composition is in the range of from about four and four-tenths inches per second (4.4 in./sec.) to about four and five-tenths inches per second (4.5 in./sec.) as measured at 25 kpsi.

6. The propellant composition of claim 1, wherein said second or faster burn rate of said second propellant composition is between about three and five times faster than said first or slowest burn rate of said second propellant composition, as measured at 25 kpsi.

7. The propellant composition of claim 6, wherein said second or faster burn rate of said second propellant composition is about four and eight-tenths times faster than said first or slower burn rate of said second propellant composition, as measured at 25 kpsi.

8. A process for the preparation of a propellant composition material, comprising the steps of:

a. preparing a first propellant composition by:

heating an energetic oxetane thermoplastic elastomeric binder comprising from about five percent to about thirty percent by weight, based on the total weight of said first propellant, and chosen from the group consisting of 3,3-bis-azidomethyl-oxetane (BAMO), 3-azidomethyl-3-methyloxetane (AMMO), and combinations thereof, to a temperature of about ninety-five degrees Celsius (95° Celsius) or until said elastomeric binder melts, and mixing into said elastomeric binder a high energy explosive filler comprising from about seventy percent to about ninety-five percent by weight, based on the weight of said first propellant, and chosen from the group consisting of hexanitrohexaazaisowurtzitane (CL-20), 1,3,3-trinitroazetidine (TNAZ), cyclotrimethylene trinitramine (RDX), and combinations thereof, to form a first propellant composition having an impetus of at least about thirteen hundred joules per gram (1300 J/g) and a relatively slow burn rate measured at 25 kpsi;

cooling said first propellant composition to a temperature of from about fifty-five degrees Celsius (55° Celsius) to about ninety-one degrees Celsius (91° Celsius) to solidify said first propellant composition;

b. preparing a second propellant composition by:

heating an energetic oxetane thermoplastic elastomeric binder comprising from about five percent to about thirty percent by weight, based on the total weight of said second propellant, and chosen from the group consisting of 3,3-bis-azidomethyl-oxetane (BAMO), 3-azidomethyl-3-methyloxetane (AMMO), and combinations thereof, to a temperature of about ninety-five degrees Celsius (95° Celsius) or until said elastomeric binder melts, and mixing into said elastomeric binder a high energy explosive filler comprising from about seventy percent to about ninety-five percent by weight, based on the weight of said second propellant, and chosen from the group consisting of hexanitrohexaazaisowurtzitane (CL-20), 1,3,3-trinitroazetidine (TNAZ), cyclotrimethylene trinitramine (RDX), and combinations thereof, to form a second propellant composition having an impetus of at least about thirteen hundred joules per gram (1300 J/g) and a second and relatively fast burn rate on the order of about three times faster than said first burn rate of said first propellant composition as measured at 25 kpsi;

cooling said second propellant composition to a temperature of from about fifty-five degrees Celsius (55° Celsius) to about ninety-one degrees Celsius (91° Celsius) to solidify said second propellant composition;

c. mixing said first propellant composition and said second propellant composition, and extruding the mixture in a desired form.

9. An extruded propellant material prepared by the method of:

a. preparing a first propellant composition by:

heating an energetic oxetane thermoplastic elastomeric binder comprising from about five percent to about thirty percent by weight, based on the total weight of said first propellant, and chosen from the group consisting of 3,3-bis-azidomethyl-oxetane (BAMO), 3-azidomethyl-3-methyloxetane (AMMO), and combinations thereof, to a temperature of about ninety-five degrees Celsius (95° Celsius) or until said elastomeric binder melts, and mixing into said elastomeric binder a high energy explosive filler comprising from about seventy percent to about ninety-five percent by weight, based on the weight of said first propellant, and chosen from the group consisting of hexanitrohexaazaisowurtzitane (CL-20), 1,3,3-trinitroazetidine (TNAZ), cyclotrimethylene trinitramine (RDX), and combinations thereof, to form a first propellant composition having an impetus of at least about thirteen hundred joules per gram (1300 J/g) and a first and relatively slow burn rate measured at 25 kpsi;

cooling said first propellant composition to a temperature of from about fifty-five degrees Celsius (55° Celsius) to about ninety-one degrees Celsius (91° Celsius) to solidify said first propellant composition;

b. preparing a second propellant composition by:

heating an energetic oxetane thermoplastic elastomeric binder comprising from about five percent to about thirty percent by weight, based on the total weight of said second propellant, and chosen from the group consisting of 3,3-bis-azidomethyl-oxetane (BAMO), 3-azidomethyl-3-methyloxetane (AMMO), and combinations thereof, to a temperature of about ninety-five degrees Celsius (95° Celsius) or until said elastomeric binder melts, and mixing into said elastomeric binder a high energy explosive filler comprising from about seventy percent to about ninety-five percent by weight, based on the weight of said second propellant, and chosen from the group consisting of hexanitrohexaazaisowurtzitane (CL-20), 1,3,3-trinitroazetidine (TNAZ), cyclotrimethylene trinitramine (RDX), and combinations thereof, to form a second propellant composition having an impetus of at least about thirteen hundred joules per gram (1300 J/g) and a second and relatively fast burn rate on the order of about three times faster than said first burn rate of said first propellant composition, as measured at 25 kpsi;

cooling said second propellant composition to a temperature of from about fifty-five degrees Celsius (55° Celsius) to about ninety-one degrees Celsius (91° Celsius) to solidify said second propellant composition;

c. mixing said first propellant composition and said second propellant composition, and extruding the mixture in a desired form.

10. The propellant composition of claim 9, further comprising an explosive plasticizer comprising from about four percent to about seven percent by weight, based on the weight of said propellant composition, and chosen from the group consisting of 1,3,3-trinitroazetidine (TNAZ), butanetrio-trinitrate (BTTN), trimethylolethane trinitrate (TMETN), triethylene glycol dinitrate (TEGDN), bis,2,2-dinitropropylacetyl/bis2,2-dinitropropylformal (BDNPA/F), methylnitratoethylnitramine (methyl NENA), ethylnitratoethylnitramine (ethyl NENA), and combinations thereof.

* * * * *